US005928724A

United States Patent [19]

Descamps et al.

[11] Patent Number: 5,928,724

[45] Date of Patent: Jul. 27, 1999

[54] METHOD OF MAKING A BUILDING ELEMENT

[75] Inventors: Pierre Descamps, Rixensart; Martin Harvey, Waterloo, both of Belgium

[73] Assignee: Dow Corning S.A., Seneffe, Belgium

[21] Appl. No.: 09/047,740

[22] Filed: Mar. 25, 1998

[51] Int. Cl.[6] ..... B05D 1/38; B05D 3/02

[52] U.S. Cl. ..... 427/230; 427/387; 427/407.2

[58] Field of Search ..... 427/230, 407.2, 427/387

[56] References Cited

U.S. PATENT DOCUMENTS

| | | | |
|---|---|---|---|
| 3,020,260 | 2/1962 | Nelson | 260/46.5 |
| 3,419,593 | 12/1968 | Willing | 260/448.2 |
| 5,262,397 | 11/1993 | Descamps et al. | 523/219 |
| 5,595,032 | 1/1997 | Richards et al. | 52/306 |

FOREIGN PATENT DOCUMENTS

| | | |
|---|---|---|
| 841 825 | 7/1960 | United Kingdom . |
| 849 885 | 9/1960 | United Kingdom . |
| 945 580 | 6/1964 | United Kingdom . |
| 1 189 270 | 4/1970 | United Kingdom . |
| 1 281 343 | 7/1972 | United Kingdom . |
| 1 294 308 | 10/1972 | United Kingdom . |
| 1 304 362 | 1/1973 | United Kingdom . |
| 1 495 951 | 12/1977 | United Kingdom . |
| 1 581 762 | 12/1980 | United Kingdom . |

*Primary Examiner*—Erma Cameron
*Attorney, Agent, or Firm*—Patricia M. Scaduto

[57] ABSTRACT

An improved method of making glass building elements filled with cured polydiorganosiloxane compositions. The method comprises first coating the interior surfaces of a hollow glass block with a first curable polydiorganosiloxane composition. This first composition is then cured. Next, the block is charged with a quantity of a second curable polydiorganosiloxane composition. This second composition is then cured to form the building element. The resultant element has improved aesthetics because of the decreased quantity of entrapped bubbles.

7 Claims, 1 Drawing Sheet

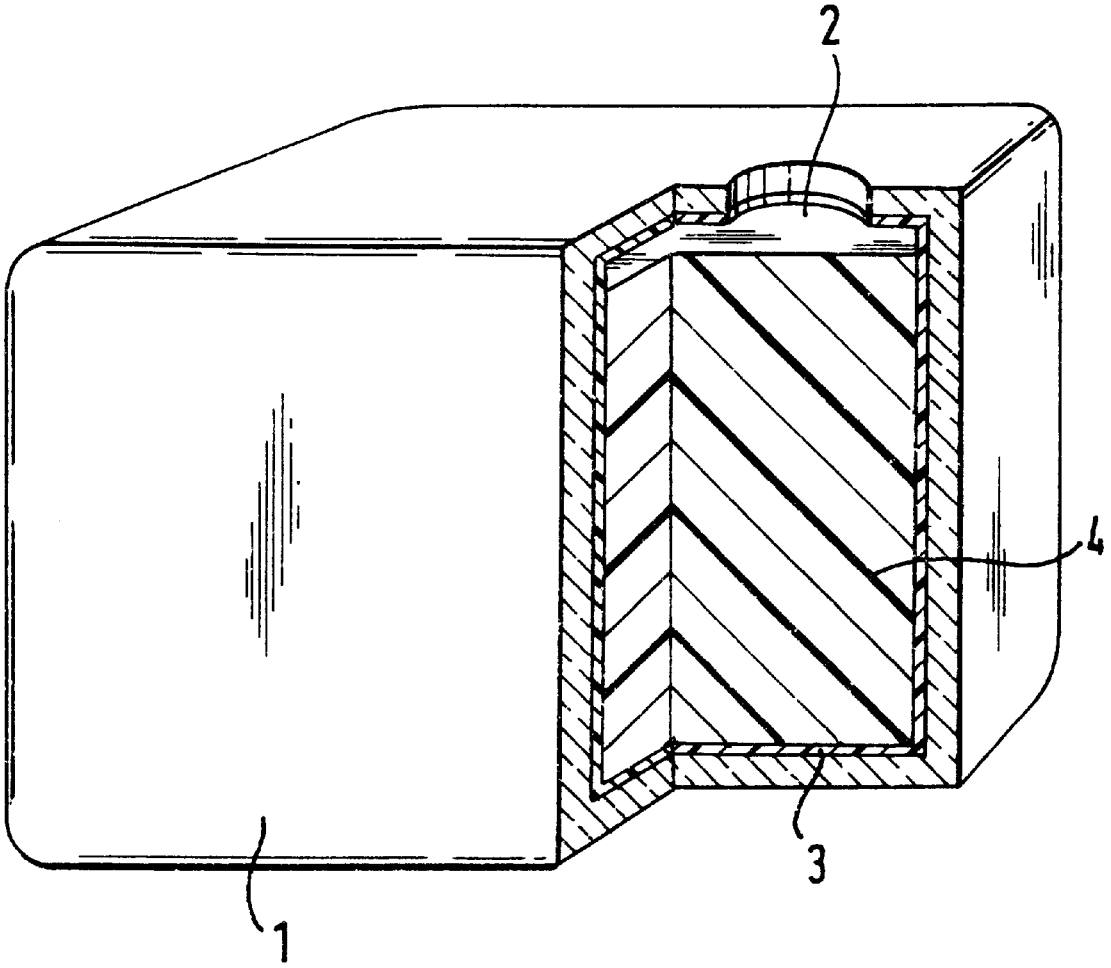
2
4
3
1

METHOD OF MAKING A BUILDING ELEMENT

BACKGROUND OF THE INVENTION

1. Field of the Invention

This invention relates to a method of making improved building elements. More particularly it relates to a method of making glass building blocks filled with silicone in which the number of bubbles contained in the silicone is greatly reduced.

2. Background Information

The use of glass blocks in building construction is well-known. They are employed in place of masonry bricks in walls, for example where it is desired to permit viewing through an exterior wall. They are also employed to form internal walls or parts thereof to permit the passage of light and/or for aesthetic reasons.

In GB 1 294 308 there is described a building block comprising a hollow transparent body partially filled with a liquid (e.g. water) and having one oblique wall such that light can be reflected, refracted and filtered by the body of the blocks and by the liquid therein.

In GB 1 495 951 there is described a wall structure comprising a plurality of superposed hollow blocks of material transparent to visible light such as glass. The blocks are partially filled with a transparent liquid (e.g. water) and also contain a prismatic body such that light can be reflected, refracted and filtered. Such a building block is capable of transmitting light through the wall.

It is also known from U.S. Pat. No. 2,724,260 that certain faces of glass blocks may be coated with a thin film of organopolysiloxane to prevent the adhesion of mortar thereto.

Finally, U.S. Pat. No. 5,595,032 teaches glass building blocks which are filled with a silicone composition. While such blocks have greatly improved aesthetics, the silicone in these blocks can contain air bubbles which may impair the clarity of the block.

We have now found that building elements can be made comprising a hollow glass block filled with silicone in which the number of bubbles within said silicone is greatly reduced by coating the interior of the block with a silicone prior to its final filling.

SUMMARY OF INVENTION

In one of its aspects this invention provides a method of making a building element containing a cured polydiorganosiloxane composition comprising:

wetting interior surfaces of a hollow, glass building block with a quantity of a first curable polydiorganosiloxane composition to form a coating on said surfaces;

curing said first polydiorganosiloxane composition;

charging the block with a quantity of a curable polydiorganosiloxane composition which, when cured, permits expansion of the cured product relative to the block during changes in temperature; and curing said second mentioned polydiorganosiloxane composition.

The resultant blocks contain decreased quantities of bubbles and, thus, have improved clarity.

BRIEF DESCRIPTION OF THE DRAWING

A perspective view of a building element with a portion cut away.

DETAILED DESCRIPTION OF INVENTION

In the first step of the present invention, the interior surfaces of a hollow, glass building block are coated with a sufficient quantity of a curable polydiorganosiloxane composition to form a coating on said surfaces. The method for applying such coating is not critical and can include, for example, spraying or coating the interior surfaces of the block with the polydiorganosiloxane composition during block manufacture. In an alternative, preferred embodiment, a hole is drilled or preformed in a constructed block, a quantity of the polydiorganosiloxane composition is dispensed into the block and the block is agitated until the interior surfaces are sufficiently wet.

The polydiorganosiloxane compositions which can be used in this step include those which cure to an elastomeric or gel-like state, preferably at temperatures of about 22° C. or moderately elevated temperatures, for example up to about 100° C. Such curable compositions comprise a polydiorganosiloxane having silicon-bonded reactive groups, preferably hydroxyl groups or alkenyl groups, and one or more substances for effecting cross-linking of the polydiorganosiloxane via the reactive groups. The composition may or may not contain a catalyst for initiating or expediting the crosslinking reaction.

The preferred curable compositions are those comprising two or more components. In compositions of this type, the relevant reactive components are separately packaged and the contents of the packages are mixed when they are to be used.

Curable compositions of the two-component type include those comprising mixtures of a polydiorganosiloxane having terminal, silicon-bonded hydroxyl groups and silanes having alkoxy groups and/or partial hydrolysates of such silanes, for example n-propyl silicate and ethyl polysilicate. Cure of these types of compositions is normally catalysed by incorporation of a metal organic compound. In particular, a metal carboxylate such as stannous octoate, dibutyltin diacetate or dibutyltin dilaurate can be used.

Compositions of this type are well known in the silicone art and are described in, for example, GB Patents 841 825, 1 295 194 and 1 304 362.

Most preferred for use according to the present invention are polydiorganosiloxane compositions comprising (A) a polydiorganosiloxane having at least two silicon-bonded ethylenically-unsaturated groups, (B) at least one organohydrogensiloxane having at least two silicon-bonded hydrogen atoms per molecule and (C) a catalyst for promoting the reaction of the SiH groups with the unsaturated groups.

Elastomer- and/or gel-forming compositions comprising (A), (B) and (C) are well-known and have been described, for example, in British Patents 849 885, 945 580, 1 189 270, 1 581 762 and 1 281 343 and U.S. Pat. No. 3,020,260.

Compositions comprising (A), (B) and (C) cure by a reaction which does not produce flammable by-products. They are, therefore, particularly preferred for applications where fire resistance is a desired property.

Preferably at least 70 percent of the total silicon-bonded substituents in the polydiorganosiloxane are methyl groups. The remaining substituents are selected from the required reactive groups, alkenyl groups, phenyl groups, alkyl groups having from 2 to 8 carbon atoms and fluorinated alkyl groups having from 3 to 8 carbon atoms.

The reactive groups in polydiorganosiloxane (A) are silicon-bonded ethylenically unsaturated groups. Preferably, the reactive groups are those having from 2 to 8 carbon atoms, for example vinyl, allyl or hexenyl groups. The proportion of such groups required in the polydiorganosiloxane to realise the desired elastomeric or gel-like product will be known to, or readily ascertainable by, those skilled in the art of silicone chemistry. Generally, however, the proportion of alkenyl groups does not exceed about 2 or 3 percent of the total number of silicon-bonded substituents in the molecule. The alkenyl groups may be present attached to terminal silicon atoms, non-terminal silicon atoms or to both.

Examples of the preferred polydiorganosiloxanes (A) include copolymers of dimethylsiloxane, methylvinylsiloxane and trimethylsiloxane units, copolymers of dimethylsiloxane, phenylmethylsiloxane and dimethylvinylsiloxane units, copolymers of dimethylsiloxane, methylhexenylsiloxane and dimethylhexenylsiloxane units, copolymers of dimethylsiloxane, methylvinylsiloxane and phenyldimethylsiloxane units and mixtures of two or more of such polydiorganosiloxanes.

Crosslinker (B) is well-known in the art of organosiloxane elastomers and gels. Organohydrogensiloxanes (B) have on average at least two silicon-bonded hydrogen atoms per molecule. The remaining valencies of the silicon atoms are satisfied with organic groups selected from alkyl groups having from one to six carbon atoms e.g. methyl, ethyl and hexyl and phenyl groups. Preferred from cost and availability considerations are organohydrogensiloxanes in which at least 80% and more preferably substantially 100% of the total organic substituents are methyl.

The organohydrogensiloxanes (B) may be homopolymers or copolymers. For example, they may be polymethylhydrogen-siloxanes, trimethylsiloxy-terminated polymethylhydrogen-siloxanes, copolymers of dimethylsiloxane, methylhydrogen-siloxane and trimethylsiloxane units and copolymers of dimethylsiloxane, methylhydrogensiloxane and dimethylhydrogensiloxane units. Crosslinker (B) may comprise a single organohydrogensiloxane or two or more different organohydrogensiloxanes having for example different chain lengths and/or different contents of silicon-bonded hydrogen atoms.

The proportion of (B) employed should be at least sufficient to provide the desired degree of crosslinking during cure. Depending on the type and structure of the organohydrogensiloxanes, the proportion required may vary widely. Generally, however, the proportion of (B) will fall within the range from about 5 to about 40 parts by weight per 100 parts by weight of (A).

Platinum catalyst (C) can be any of the known forms effective in promoting the reaction of SiH groups with silicon-bonded alkenyl groups. Known and suitable forms of platinum are well documented in the literature and include chloroplatinic acid, platinum compounds and complexes of platinum compounds with unsaturated organic compounds or with siloxanes having silicon-bonded groups containing olefinic unsaturation.

Examples of platinum catalysts (C) are complexes of platinous halides and olefins such as ethylene, propylene, cylcohexene and styrene, complexes of platinum halides or chloroplatinic acid with divinyltetramethyldisiloxane (see U.S. Pat. No. 3,419,593) and complexes formed by the reaction of chloroplatinic acid, divinyltetramethyldisiloxane and tetramethyldisiloxane.

The amount of the platinum catalyst used should be that which is effective in promoting the desired reaction. In general an effective amount is that which provides from 5 to 200 parts by weight of platinum per million parts of the combined weights of (A) and (B).

Fillers and other additives may be incorporated into the curable polydiorganosiloxane provided that they do not impair the desired degree of transparency or translucency in the cured composition. Suitable fillers include certain types of silicone elastomers in finely divided powder form, certain types of silica and benzene-soluble resinous copolymers of $R_3SiO_{0.5}$ units and $SiO_2$ units wherein the R groups are preferably methyl but preferably also include a minor proportion, generally up to 20 percent of the total R groups, of alkenyl, e.g. vinyl, groups. Resinous copolymers of this type are well-known in the silicone art and can be prepared by the method described in, for example, U.S. Pat. No. 2,676,182. The ratio of $R_3SiO_{0.5}$ units to $SiO_2$ units may vary from about 0.5:1 to about 1:1, preferably from 0.6:1 to 0.8:1.

Other additives which may advantageously be present in the curable compositions include substances for improving the adhesion of the cured composition to the glass block and substances which confer flame retardant properties, for example, compounds of transition metals such as titanium butoxide and zirconium octoate.

It has been found that the incorporation of low molecular weight polydimethylsiloxanes having terminal triorganosiloxy groups, wherein the organo groups are alkyl or aryl, can improve the adhesion of the cured gel to the interior of the glass block. Such materials can also be added to lower the modulus of the cured product where this is desirable in order to reduce stresses caused by differential expansion and contraction during changes in the ambient temperature.

The quantity of polydiorganosiloxane composition used in this first step of the process can vary greatly depending on the thickness of the coating desired. Generally, however, the quantity used is in the range of between about 0.1 and about 5 percent, preferably about 0.5 percent of the total volume of the cavity in the block.

The curable polydiorganosiloxane composition coated on the interior surfaces of the block is then cured. As set forth above and depending on the polydiorganosiloxane composition used, this can be accomplished at a temperature of about 22° C. or moderately elevated temperatures, for example up to about 100° C. The cure can take place in several minutes or several days, again depending on the polydiorganosiloxane composition and the temperature chosen.

Although not wishing to be bound by theory, it is postulated that this coating encapsulates small pieces of glass close to the surface and thereby prevents them from entering into suspension of the bulk resin of the block. Additionally, it is postulated that the resins react with any hydroxyl groups on the surface of the block and generate hydrogen gas. However, since the coating is relatively thin, the hydrogen readily diffuses through the coating prior to filling the block with the bulk resin. In this manner, entrapped bubbles of hydrogen are greatly reduced compared with prior art process which do not include the pre-coating.

Next, the block is filled with a curable polydiorganosiloxane composition. Again, the method of filling is not critical and can include, for example, merely dispensing the desired quantity of the polydiorganosiloxane composition through a hole or holes drilled or preformed in the block.

The curable polydiorganosiloxane composition used to fill the block is selected from the same polydiorganosiloxane compositions used in the coating step as described above and may be the same as or different from the composition used as the coating. In a preferred embodiment, the polydiorganosiloxane composition used to coat the interior of the block and the polydiorganosiloxane composition used to fill the block are the same.

The quantity of polydiorganosiloxane composition used during this step in the process is such that the resultant cured material can expand relative to the block during changes in temperature, although lesser amounts can also be used therein.

The polydiorganosiloxane composition used to fill the block is then cured. This curing takes place in the same manner and under the same conditions as described for the first polydiorganosiloxane composition.

Glass blocks according to the invention have an improved aesthetic appeal because the decreased quantity of bubbles improves the clarity of the block.

In order that the invention may become more clear there now follows a description of one example method according to the invention. This description is to be read with the accompanying drawing which represents a perspective view of a building element with a portion cut away. Unless otherwise stated, all parts are by weight and all viscosities are at 25° C.

EXAMPLE

A curable composition was formed by mixing two component parts (Parts A and B).

Part A was prepared by mixing 86.4 parts of a dimethylvinylsiloxy-end stopped polydimethylsiloxane ($4.5\times10^{-4}$ $m^2/s$), 2 parts of a trimethylsiloxy-end stopped polymethylhydrogensiloxane ($3\times10^{-5}$ $m^2/s$) 18 parts of a copolymer of dimethyl-siloxane and methylhydrogen siloxane ($5\times10^{-6}$ $m^2/s$), 0.6 part methylvinylcyclotetrasiloxane and 10.7 parts of a polydimethylsiloxane having terminal triorganosiloxy groups and of viscosity 20 cSt.

Part B was prepared by mixing 99.9 parts of a dimethylvinylsiloxy-end stopped polydimethylsiloxane ($2\times10^{-3}$ $m^2/s$) and 0.2 part of a complex of chloroplatinic acid and divinyltetramethyldisiloxane.

Parts A and B were mixed in a weight ratio of approximately 7.5:92.5 to provide a curable composition in which the ratio of reactive vinyl groups to reactive silicon-bonded hydrogen atoms is approximately 1 or slightly less than 1.

The curable composition was introduced into a hollow glass block (1) via a fill hole (2) whilst still in a flowable condition. The block was then rotated so as to form a coating (3) of the composition of at least substantially uniform thickness on the interior surfaces of the block. The coating was then allowed to cure by leaving the block at room temperature (about 22° C.) for 24 hours.

Another batch of the curable composition was mixed in the same ratio and charged into the pretreated block prepared above by introduction through the same fill hole (2). The curable composition was then allowed to cure to form a body of cured silicone (4) by leaving the block at room temperature (about 22° C.) for 48 hours.

The resultant block was clear and free of bubbles and visible defects throughout the element so produced.

That which is claimed is:

1. A method of making a building element containing a cured polydiorganosiloxane composition comprising:

wetting interior surfaces of a hollow, glass building block with a quantity of a first curable polydiorganosiloxane composition to form a coating on said surfaces;

curing said first polydiorganosiloxane composition;

charging the block with a quantity of a second curable polydiorganosiloxane composition which, when cured, permits expansion of the cured second polydiorganosiloxane relative to the block during changes in temperature; and curing said second polydiorganosiloxane composition.

2. A method according to claim 1 wherein the first curable polydiorganosiloxane composition and the second curable polydiorganosiloxane composition are the same.

3. A method according to claim 1 wherein the polydiorganosiloxane compositions each comprise (A) a polydiorganosiloxane having at least two silicon-bonded ethylenically-unsaturated groups, (B) at least one organohydrogensiloxane having at least two silicon-bonded hydrogen atoms per molecule and (C) a catalyst for promoting the reaction of the SiH groups in (B) with the ethylenically-unsaturated groups in (A).

4. A method according to claim 1 further comprising a polydimethylsiloxane having terminal triorganosiloxy groups wherein the organic groups are alkyl or aryl.

5. In a method of making a building element charged with a cured polydiorganosiloxane composition comprising the steps of filling a hollow glass block with a curable polydiorganosiloxane composition and then curing said polydiorganosiloxane composition, the improvement comprising:

wetting the interior surfaces of the hollow glass block with a first curable polydiorganosiloxane composition and curing said first curable polydiorganosiloxane composition prior to charging the block with a second curable polydiorganosiloxane composition and curing the second polydiorganosiloxane composition.

6. A method according to claim 2 further comprising a polydimethylsiloxane having terminal triorganosiloxy groups wherein the organic groups are alkyl or aryl.

7. A method according to claim 3 further comprising a polydimethylsiloxane having terminal triorganosiloxy groups wherein the organic groups are alkyl or aryl.

* * * * *